United States Patent [19]

Diaz

[11] Patent Number: 4,923,198

[45] Date of Patent: May 8, 1990

[54] BOARD GAME OF GEOPOLITICAL AND RELATED KNOWLEDGE

[76] Inventor: Francisco J. Diaz, 9 Leonard Ct., Rockville, Md. 20850

[21] Appl. No.: 364,103

[22] Filed: Jun. 12, 1989

[51] Int. Cl.[5] ..... A63F 3/04

[52] U.S. Cl. ..... 273/240; 273/242; 273/254; 273/257

[58] Field of Search ..... 273/239, 240, 242, 243, 273/251, 252, 254, 268, 257, 271, 279

[56] References Cited

U.S. PATENT DOCUMENTS

| | | | |
|---|---|---|---|
| 459,952 | 9/1891 | Wood | 273/279 |
| 613,435 | 11/1898 | Wright | 273/252 |
| 635,898 | 10/1899 | Prendergast . | |
| 753,949 | 3/1904 | Wing | 273/279 |
| 1,481,713 | 1/1924 | Hulsmann . | |
| 1,562,778 | 11/1925 | McGowan | 273/251 |
| 1,770,101 | 7/1930 | Dougherty . | |
| 2,837,836 | 6/1958 | Morawitz . | |
| 3,347,550 | 10/1967 | Carboni | 273/236 |
| 3,363,902 | 1/1968 | Jones . | |
| 3,711,966 | 1/1973 | Drcsak . | |
| 4,593,910 | 6/1986 | Font | 273/287 X |

*Primary Examiner*—Edward M. Coven
*Assistant Examiner*—William E. Stoll
*Attorney, Agent, or Firm*—Richard C. Litman

[57] ABSTRACT

A board game requiring some knowledge of geographical, historical, political, sociological and/or related facts for the successful player is disclosed. The game comprises a game board which includes a map of the United States or other geopolitical area, spaces for question and answer cards, an inner and an outer border, and state markers which conceal the names of the states on the map when installed. Play is started on the outer border, which contains representations of each of the states or other areas contained on the map. Players may choose a given state or area, correctly identify the state or area, and transfer the marker from the main map to the corresponding state or area of the outer border, thereby uncovering the name and confirming their actions. After a maximum of five plays per player on the outer border, players move to the inner border where movement is determined by the tossing of dice. Cards are drawn with questions pertaining to the corresponding categories of the segments of the inner border. Movement around the inner border may proceed in either direction according to the choice of the player. The winner is determined as the first player to correctly complete his or her scoresheet based upon his or her answers to the questions of the cards drawn. Alternatively, the end of the game may be determined by the completion of a predetermined percentage of the score sheet, a predetermined time interval, or a predetermined number of laps of the inner border. The game may also be played using a computer and suitable programming.

9 Claims, 3 Drawing Sheets

CATEGORIES

RED

1. IMPORTANT CITIES
2. REV. WAR
3. AUTHORS, ARTISTS
4. NAT. PARKS, MONUMENTS

WHITE

5. GEOGRAPHY
6. CIVIL WAR
7. ENGLISH
8. CIVICS

BLUE

9. DO YOU KNOW
10. EARLY AMERICANS
11. SPACE AGE
12. SPORTS

FIG. 4

WHITE CARDS

ANSWER 1
5.
6.
7.
8.

ANSWER 2
5.
6.
7.
8.

ANSWER 3
5.
6.
7.
8.

ANSWER 4
5.
6.
7.
8.

ANSWER 5
5.
6.
7.
8.

ANSWER 6
5.
6.
7.
8.

FIG. 5

BOARD GAME OF GEOPOLITICAL AND RELATED KNOWLEDGE

FIELD OF THE INVENTION

This invention relates generally to board games, and more particularly to board games in which players may demonstrate and learn geographical, political, historical, sociological and related knowledge for advancement during the course of the game. The game is particularly directed toward facts and knowledge relating to the United States of America, but the general rules and principles of the game may be applied to other nations and geopolitical areas as well.

BACKGROUND OF THE INVENTION

Many professional educators and academic experts have concluded that such subjects as geography, history, political science, and sociology and the like have been neglected to a great extent in the educational system. There may be many reasons for this neglect of such important subjects, such as the need for more time for various other academic subjects in the school environment as other subjects demand more attention in this increasingly complex world. The above subjects are also often perceived as relatively uninteresting, perhaps due to the requirement for memorization of various facts associated with the subjects.

For whatever reasons, the knowledge of the average student and citizen related to the above subject areas has been shown to be in need of improvement. Due to the circumstances noted above, however, such improvement has been difficult to achieve. The above noted obstacles may be overcome in many ways, but perhaps the most obvious would be through additional time spent on the subjects in a non academic environment, allowing the use of academic time for other subjects, and/or a method of instilling such knowledge in a way which would be enjoyable to those persons participating.

The need arises for a game capable of being played by two or more persons in an academic or non academic environment, in which knowledge of the subjects of geography, history, and sociology and the like is learned and/or taught. Such a game should be capable of instilling facts relating to the above subject areas in players of the game and also testing their knowledge of such facts. The game should include means for scorekeeping in order to provide for competition among players and therefore provide an enjoyable and interesting game, and also to provide for a method of grading students on their knowledge displayed during the course of the game when it is played in an academic environment.

DESCRIPTION OF THE RELATED ART

Various patents disclosing games relating to the subjects of geography, history, sociology and other similar subject areas are known in the art. U.S. Pat. No. 1,346,826 issued to Huggins is an example. While this game does incorporate methods and rules of play which do indeed test and teach knowledge of geography, the game is directed to a simulation of travel across a map of the United States or other country. As will be seen, the present invention also incorporates the movement of pieces upon a game board, but rather than using the map incorporated with the board, uses the perimeter of the board for travel.

Sakanashi U.S. Pat. No. 1,492,339 also discloses a geographical board game in which a map is used as the playing surface for the advancement of the playing pieces. In this game, lettered rather than numbered dice are used in order to determine player advancement across the board. As the game is based upon the use of the lettered dice, the amount of geographical knowledge required to successfully play the game is relatively limited. In this game as well as others known in the art, players must start from a predetermined point, an arrangement which further limits the versatility of the game.

None of the above listed patents, either singly or in combination, are seen to disclose the specific construction and method of play disclosed in the present invention.

SUMMARY OF THE INVENTION

By the present invention, an improved board game incorporating means for the teaching and testing of geographical, historical, political and sociological knowledge, and the like, is disclosed.

Accordingly, it is an object of the present invention to provide a board game using geographical, historical, political and sociological knowledge, and the like, in which the starting point for each player is to a great extent determined individually by that player.

It is another object of the present invention to provide a board game using geographical, historical, political and sociological knowledge, and the like, which allows a plurality of paths of travel for playing pieces around the perimeter of the board, such paths of travel being ranked according to the level of play of the individual players during the course of the game.

It is yet another object of the present invention to provide a board game using geographical, historical, political and sociological knowledge, and the like, in which playing pieces may be moved either forward or backward along the path of travel, according to the desires of the individual players causing such moves.

It is a further object of the present invention to provide a board game using geographical, historical, political and sociological knowledge, and the like, in which the completion of the game is determined by the attainment of a given score, rather than the reaching of a given location on the board representing a geographical location.

It is an additional object of the present invention to provide a board game using geographical, historical, political and sociological knowledge, and the like, in which the completion of the game may be determined by the passage of a given time interval.

It is also an object of the present invention to provide a board game using geographical, historical, political and sociological knowledge, and the like, in which the completion of the game may be determined by the completion of a given number of laps around the perimeter of the board by the playing pieces.

It is yet another object of the present invention to provide a board game using geographical, historical, political and sociological knowledge, and the like, in which individual playing pieces may be used to represent given geographical or political areas, the movement of such pieces having based upon the responses of the players to questions relating to those areas.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 4 is a table of the categories of questions used in the play of the game.

FIG. 5 is a view of the scoresheet used in the game.

Similar reference characters designate corresponding parts throughout the several figures of the drawings.

DESCRIPTION OF THE PREFERRED EMBODIMENT

Figure 1:
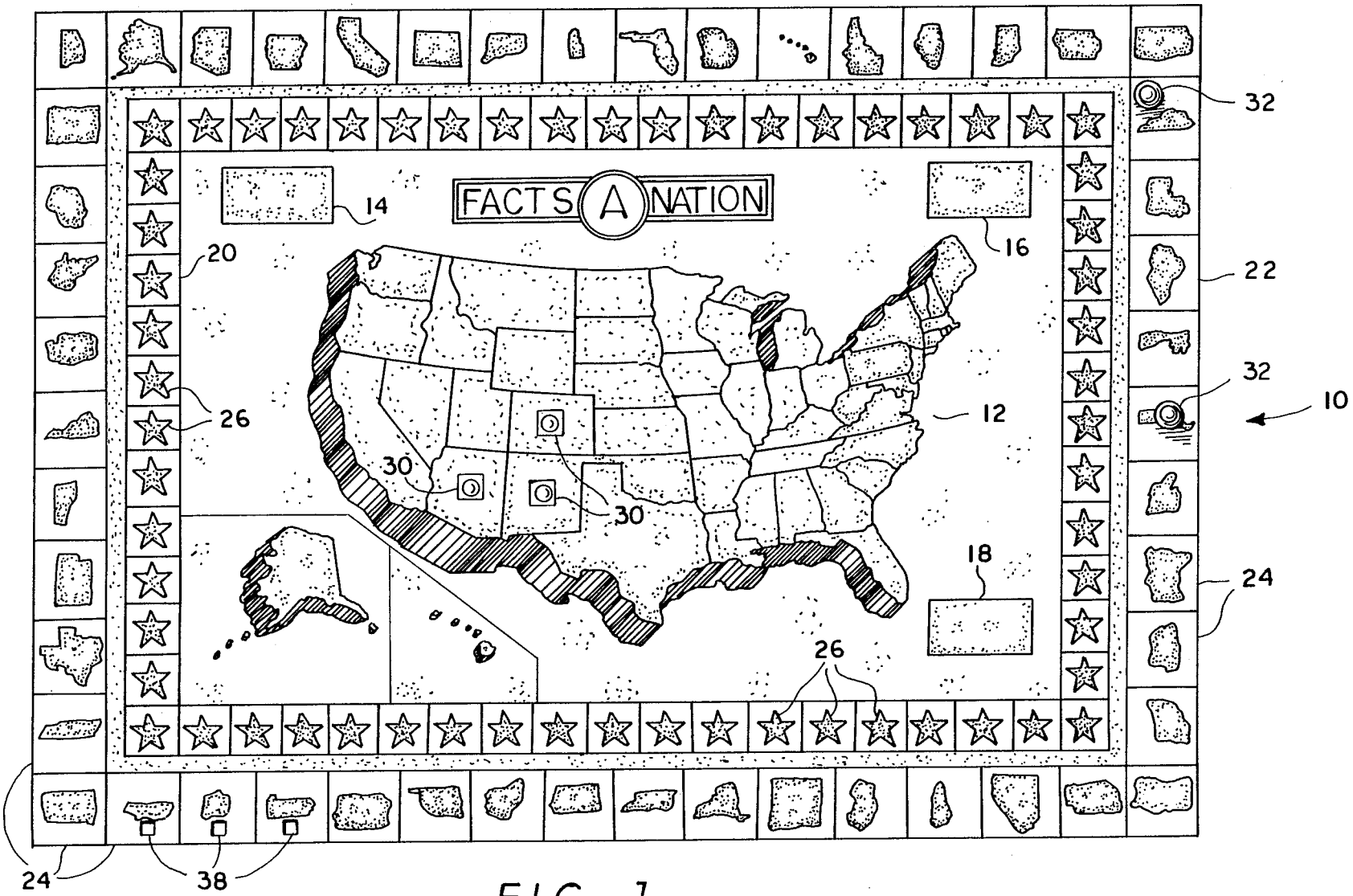
FIG. 1 is a view of the game board used with the game, including playing pieces used in the game.

Referring now to the drawings, particularly FIG. 1, the present invention will be seen to relate to a board game incorporating the teaching and learning of geographical, historical, political and sociological information, and the like, by players. The board 10 used in the playing of the game contains a map of the United States 12, spacers 14, 16, and 18 for red, white, and blue cards respectively, an inner border 20, and an outer border 22. Other geographical or political maps and/or areas may also be used for other versions of the game.

Figure 2A:
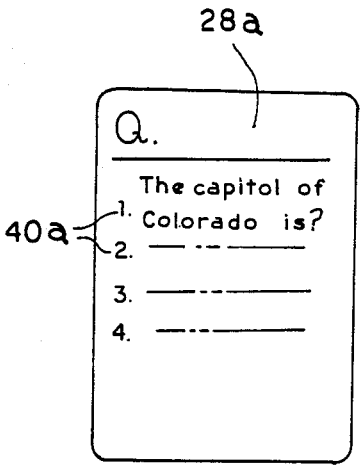
FIG. 2*a* is a view of the front surface of a card used in the game, showing examples of questions used in the play of the game.
Figure 2B:
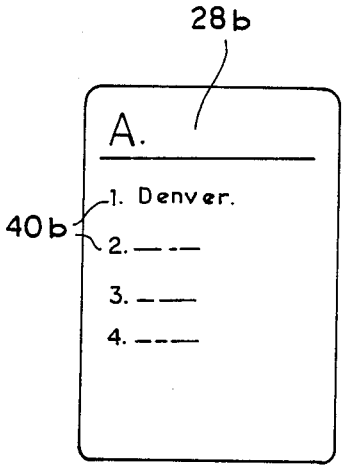
FIG. 2*b* is a view of the reverse surface of the card of FIG. 2*a*, showing examples of answers for the questions on the card of FIG. 2*a*.

Outer border 22 comprises a series of fifty individual rectangular areas 24, each containing a representation of one of the fifty states arranged in alphabetical order from the upper left corner of the board 10. Inner border 20 comprises a series of segments containing stars 26 alternatingly colored red, white and blue and marked with question categories. These colors correspond to question and answer cards 28, an example of which is shown in FIGS. 2*a* and 2*b* as front view 28*a* and back view 28*b* respectively. These cards 28 of the appropriate red, white or blue color are placed in the corresponding colored spaces 14, 16, and 18 of the board 10 prior to the beginning of the game.

Figure 3:
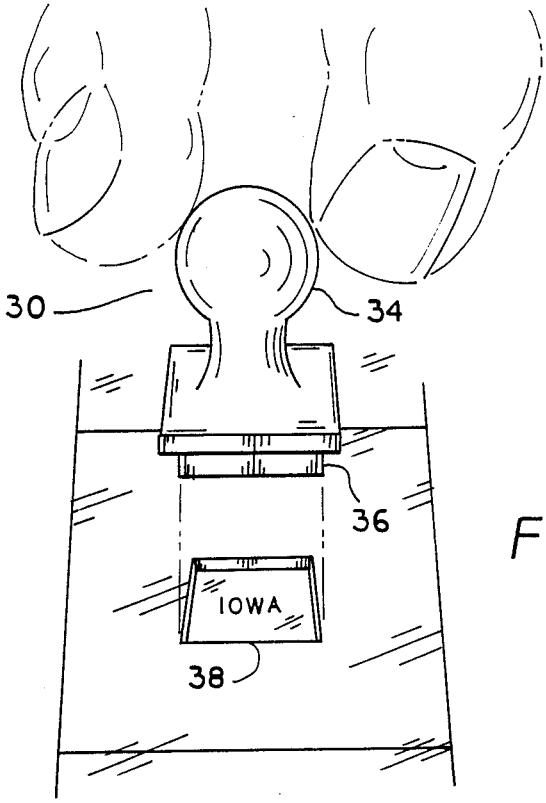
FIG. 3 is a perspective view of a portion of the game board and a game piece, showing their relationship.

Game playing pieces are of two types: State markers 30, more clearly shown in FIG. 3, and individual player position markers 32, top views of which are shown in FIG. 1. Markers 32 may be of any suitable shape, size and/or color. State markers 30 comprise an easily graspable upper portion 34 and a base 36 patterned to fit within corresponding depressions 38 which are located within each state on the map 12. State markers 30 are installed within the depressions 38 on the map 12 prior to the beginning of the game, and replaced in other depressions 38 within the outer border 22 during the course of the game. The base portion of each marker 30 is sufficiently large to conceal the name of the state over which it is installed, thus requiring the player to correctly name the state before the removal of the appropriate marker 30 from each depression 38 within each state on the map 12 during the course of the game, as more fully described below.

Red, white, or blue cards 28 as shown in FIGS. 2*a* and 2*b* contain questions 40*a* and answers 40*b* to be used by the players during the course of the game. Each card 28 contains four questions 40*a* as shown on the front surface 28*a* of the card 28 of FIG. 2*a*, and the correct answers 40*b* to those questions 28*a* on the reverse side 28*b* of the card 28, as shown in FIG. 2*b*. The questions 40*a* are defined by categories, as shown in the table of FIG. 4. Thus, each red card 28 installed in space 14 of the board 10 contains questions and answers relating to important cities, the Revolutionary War, authors and/or other artists, and national parks, monuments and battlefields; each white card 28 contains questions and answers relating to bodies of water and other geographical landmarks and areas, the Civil War, the English language and spelling, and the political and governmental system and persons associated with the system; and each blue card 28 contains questions and answers relating to the Washington, D.C. area and nicknames and superlatives, early Americans or other historical figures, the space age, and sport. These categories are flexible and may be adjusted for more specific users or needs, such as different school grades or age groups, etc.

Answer sheets as shown in FIG. 5 are provided, one answer sheet for each color of cards 28. Each answer sheet provides space for six answers to questions contained in each of the four categories as listed on the respectively colored cards 28, or twenty four answers, which provides space for a total of seventy two answers on the three answer sheets to be used by each player during the game.

Order and progression of play are determined by the tossing of dice, not shown. Each die is a solid cube comprising six sides, each side marked with a number of dots from one through six, as is well known. One or two dice may be used. To begin play, each player tosses the die or dice. The highest resulting number allows that player to play first, the next highest to play second, and so on. Ties may be broken by a subsequent toss of the die or dice by the tied players.

The first player begins the game by choosing a state contained within one of the rectangular areas 24 forming the outer border 22 of board 10. The states within this outer border 22 are not marked with their respective names, and at this point in the play of the game the states comprising the map 12 of the game have their names concealed by state markers 30. Thus, players must be able to identify the state they chose on the outer border 22 by shape and corresponding location on the map 12. Having done so, the player then removes the state marker 30 from the chosen state on the map 12 and verifies the proper identification of that state. If the player is correct, state marker 30 is placed upon the corresponding state chosen by the player in the outer border 22. Otherwise, marker 30 is replaced upon its original location on map 12, and the next player in the order of play takes his or her turn.

Assuming that a player provides the correct name of the state chosen and is thus allowed to move the state marker 30 from the map 12 to the corresponding state on the outer border 22, that player may take a second turn by tossing the die or dice and moving his or her playing piece from the state identified on the outer border 22 to another state on the outer border 22 of his or her choosing. If that player successfully identifies five consecutive states, he or she may then move to the inner border 20 and begin the second level of play of the game. In any case, no player is allowed more than five consecutive plays. At the end of five consecutive correct plays on any level, the player must surrender play to the next player in the playing order. This rule precludes the possibility of a "sweep" by any one player.

An alternative method of accomplishing play around the outer border 22 of the board 10 may be performed using the die or dice to control player position. This alternative removes the element of a player who may know a few certain states and requires that player to accept landing upon whichever state on the outer border 22 as determined by the toss of the die or dice. In this alternative, players may start at the first state at the upper left corner of the board 10 and proceed clockwise around the outer border 12 until accomplishing the identification of the required five states to proceed to the inner border 20. If the die or dice indicate that a player is to land upon a previously identified state, the player may advance to the next unidentified state.

Advancement to the inner border 20 is accomplished by moving the player piece to the most nearly adjacent star 26 on the inner border 20 after the player has correctly identified five states on the outer border 22. A player must now move a corresponding number of stars 26 according to the toss of the dice, but has the option of moving either clockwise or counterclockwise around the inner border 20. A player moving along the inner border will land upon either a red, white or blue star 26 and must then select a card 28 from the similarly colored space 14, 16 or 18. Each star 26 also contains a question category corresponding to those categories shown in FIG. 4 and described above for cards 28. The player must then correctly answer the question 40*a* contained on the top card 28 of the appropriately colored stack contained on space 14, 16 or 18 relating to the category named on the star 26 upon which he or she has landed. The players answer may be checked by referring to the answer side 28*b* of the card 28. When a player has correctly answered the question as described above, he or she may fill out the appropriate scoresheet as shown in the example of FIG. 5 and take another turn as described above, up to the limit of five consecutive turns.

As an example of the above, assume a player has landed upon a star 26 which is colored red and has the category "important cities" contained upon its surface. The player must then select the top card 28 of the appropriate stack, i.e., red, contained upon space 14 of the board 10 and answer the question 40*a* pertaining to the subject of important cities which is printed upon the front side 28*a* of that card. Such a question might state, "What is the capitol of Colorado?" If the player correctly answers the question ("Denver") he or she may fill out the scoresheet as shown in FIG. 5 by noting the answer in the appropriate space, i.e., space 1 of the red card scoresheet, corresponding to the numbers and categories shown in the table of FIG. 4.

The scoresheet of FIG. 5 contains six answer spaces for each question category. The example shown in FIG. 5 is an answer sheet for a white card which would contain questions numbered five through eight; hence, the corresponding numbers are used on the white card answer sheet shown. Thus, a total of six questions must be correctly answered in each question category. When a player has completely filled in a category by correctly answering six questions in that category, he or she may not accept a move to any star 26 which would refer the player to a question in the filled category. The player may alternatively move in the opposite direction around the inner border 20, i.e., counterclockwise rather than clockwise or vice versa, or may select a star 26 as closely adjacent as possible to the chosen direction of travel which displays the name of an unfilled category.

As noted above, in the play of the standard game a player must correctly answer a total of seventy two questions in order to complete the scoresheet. The first player to complete the scoresheet is the winner of the game. Such a requirement may result in a prohibitively long time span requirement to complete play, particularly if the game is played as a teaching aid in the classroom. Alternative means of completing the game may also be used if desired. Should time prove to be a limiting factor, the game may be played for a predetermined time period with the player correctly answering the greatest number of questions and thus completing the greatest percentage of his or her scoresheet being the winner.

Alternatively, a shortened version of the game may require correctly answering only one, two, three, four, or five of the questions in each category, the winner being determined as the first player to correctly answer the predetermined number of questions in each of the categories and fill out his or her scoresheet accordingly.

In any of the versions described above, the use of the scoresheet may have advantages in the academic or classroom setting. After the completion of the game, a teacher may collect the scoresheets from the students and use them for determining grades. Thus, the present invention provides an enjoyable means for students to establish their retention of knowledge, unlike most tests of such knowledge retention.

Yet another alternative would allow play without the use of scoresheets. This alternative may be preferable in a more casual non academic environment. In this alternative, a predetermined number of laps of the board may be used as the goal, the player first reaching that number of laps being declared the winner.

The present invention is not limited to play using a physical playing board and playing pieces and components as described above, but may also be played by means of a computer and appropriate programming. Appropriate graphics programming may be used to produce renditions of the game board on a computer monitor, while the questions may be called up along the top, bottom or other portion of the screen. Responses may be typed in using a standard keyboard or other suitable means, and the program may also store correct and/or incorrect responses and thus provide means of score keeping during the course of the game.

In many schools computer workshops and computerized teaching are becoming established, and thus a computerized version of the game utilizing a plurality of computers each interconnected to a mainframe computer and program will enable many more students or players to participate in the game simultaneously than otherwise. Such a system will save time needed to teach the subjects noted above, provide computer skills for the participants involved, enable many more players to participate, and make the learning of both the above noted subject matter associated with the game of the present invention and the associated computer skills more enjoyable to learn.

It is to be understood that the present invention is not limited to the sole embodiments described above, but encompasses any and all embodiments within the scope of the following claims.

I claim:

1. A game apparatus requiring the demonstration of geographical historical, political, and sociological knowledge, and the like, on the part of the players of the game, including;

a game board, said game board including a map of the United States or other geographical or political area, an outer peripheral path along the edges of said game board, an inner peripheral path adjacent the inner edges of said outer peripheral path, said outer peripheral path comprised of a plurality of segments, each of said segments containing the representation of a state or other geographical or political area contained within said map, said inner peripheral path comprised of a plurality of segments, each of said segments containing a category of questions relating to geographical, historical, political, and sociological or other subject matter to be answered by said players, cards of a plurality of colors, each of said cards including a front side and a reverse side, said front sides of said cards each containing a plurality of questions relating to geographical, historical, political, sociological or other subject matter to be answered by said players, each of said questions contained upon each of said cards relating to said categories contained in said segments of said inner peripheral path, said reverse sides of each of said cards containing answers corresponding to said questions on said front sides of said cards, a plurality of markers equal to the number of individual states or other geographical or political areas contained within said map and said outer periphery, and a scoresheet, whereby said players may enter correct answers to said questions and thereby provide scoring means for said game.

2. The game apparatus of claim 1 wherein:

a representation of said game board, said questions and said answers, said markers, and said scoresheet may be rendered by means of a computer, computer video monitor, and suitable programming, whereby said players may interact with said computer by means of a computer keyboard or other suitable means to accomplish the play of said game.

3. The game apparatus of claim 1 including;

said map containing identifying indicia for each state or other political or geographical area comprising said map and said states or other areas contained within said segments of said outer periphery, each state or other area contained within said map and said outer periphery containing a depression, said depressions cooperating with protrusions included on the lower surface of said markers, whereby said markers may be placed and securely held in said depressions within said states or other areas forming said map and contained within said outer periphery segments during the course of the game, thereby concealing said state or other area identification when so installed.

4. A method of playing the game of claim 1, comprising:

selection of a first player and subsequent players by chance means, said first and said subsequent players in turn each selecting a starting point upon one of said states or other areas contained within said outer periphery, identifying said selected state or area of said starting point, removing said marker from said map, thereby uncovering the name of said state or area on said map and confirming the identification provided by said first or said subsequent player, placing said marker upon said state contained within said segment of said outer periphery, continuing play in the above manner until said first and/or said subsequent players have correctly identified five states or areas, transferring play to said inner periphery, selecting one of said cards corresponding to said category of said segment of said inner periphery, answering said question on said front side of said card and comparing said answer with said reverse side of said card, noting any said answer which is correct on said scoresheet, determining the number of said segments of said inner periphery to be traversed in the next turn by chance means, and continuing in the above manner until said first player or one of said subsequent players correctly completes said scoresheet, thereby determining a winner of said game.

5. The method of play of claim 4 whereby;

said first and said subsequent players are applied a maximum of five consecutive correct turns or one incorrect turn before relinquishing play to the next player.

6. The method of play of claim 4 whereby:

each of said players may proceed in either a clockwise or a counterclockwise direction along said inner periphery according to the choice of each of said players.

7. The method of play of claim 4 whereby;

said first of one of said subsequent players first correctly completing a prearranged portion of said scoresheet is declared to be the winner of said game.

8. The method of play of claim 4 whereby;

said player having completed the greatest portion of said scoresheet at the end of a predetermined elapsed period of play is declared to be the winner of said game.

9. The method of play of claim 4 whereby;

said player first completing a predetermined number of circuits of said inner periphery is determined to be the winner of said game.

* * * * *